US008997439B2

(12) United States Patent
Ciou

(10) Patent No.: US 8,997,439 B2
(45) Date of Patent: Apr. 7, 2015

(54) FILM CLAMPING AND CUTTING DEVICE OF STRETCH WRAPPING MACHINE

(75) Inventor: Sheng-Tian Ciou, Chia Yi Hsien (TW)

(73) Assignee: Tien Heng Machinery Co., Ltd., Chia-Yi Hsien (TW)

( * ) Notice: Subject to any disclaimer, the term of this patent is extended or adjusted under 35 U.S.C. 154(b) by 544 days.

(21) Appl. No.: 13/480,870

(22) Filed: May 25, 2012

(65) Prior Publication Data

US 2013/0312366 A1 Nov. 28, 2013

(51) Int. Cl.
*B65B 41/12* (2006.01)
*B65B 11/04* (2006.01)

(52) U.S. Cl.
CPC ..... *B65B 11/045* (2013.01)

(58) Field of Classification Search
USPC ..... 53/556, 389.2, 389.3, 547, 587; 225/82
See application file for complete search history.

(56) References Cited

U.S. PATENT DOCUMENTS 5,282,346 A * 2/1994 Masuda et al. ..... 53/118
6,164,047 A * 12/2000 Rossi ..... 53/587
6,185,900 B1 * 2/2001 Martin et al. ..... 53/211
6,269,610 B1 * 8/2001 Lancaster et al. ..... 53/399
7,908,831 B1 * 3/2011 Dugan ..... 53/587
8,601,770 B2 * 12/2013 Paillet et al. ..... 53/389.3
2004/0182050 A1 * 9/2004 Pieri ..... 53/556
2009/0282788 A1 * 11/2009 McClure ..... 53/587
2010/0037562 A1 * 2/2010 Forni et al. ..... 53/461
2010/0192516 A1 * 8/2010 Olander ..... 53/399
2012/0240516 A1 * 9/2012 Chapon et al. ..... 53/203

FOREIGN PATENT DOCUMENTS

TW 398517 U1 2/2011

* cited by examiner

*Primary Examiner* — Gloria R Weeks
(74) *Attorney, Agent, or Firm* — Rosenberg, Klein & Lee

(57) ABSTRACT

A film clamping and cutting device of stretch wrapping machines is revealed. A film clamping and cutting unit and a drag set used as an auxiliary are disposed on a turntable. The drag set includes a rotatable block which is connected to an assembly wheel of the film clamping and cutting unit. The rotatable block is connected to a shaft clipped in a clip space formed between a drag plate and a clip. An elastic body is assembled between the drag plate and the clip. By way of the drag plate, the clip and the elastic body, the shaft connected to the rotatable block is not released from the clip space until a film clamping and cutting rod and a clamp reach certain positions. Thus a connection rod disposed on the rotatable block drives the clamp to clip film timely so as to clamp and cut the film precisely.

10 Claims, 6 Drawing Sheets

FILM CLAMPING AND CUTTING DEVICE OF STRETCH WRAPPING MACHINE

BACKGROUND OF THE INVENTION

1. Field of the Invention

The present invention relates to a film clamping and cutting device of stretch wrapping machines, especially to a film clamping and cutting device of stretch wrapping machines that includes a film clamping and cutting rod and a clamp. When the film clamping and cutting rod and the clamp reach certain positions, the film clamping and cutting device clamps and cuts the film precisely.

2. Description of Related Art

Refer to Taiwanese Pat. Pub. App. No. M398517, a drag set of a film clamping and cutting device of stretch wrapping machines is revealed. In order to make the movement of a shaft of a rotatable block that drives a clamp to open and close and together with the movement of a drag plate of the drag set become smoother, a bottom edge of the drag plate is a curved sliding surface. The shaft of the rotatable block is against the curved sliding surface directly. However, when elastic fatigue of an elastic part used as an auxiliary of a drag plate occurs, the force of the drag plate acted on the shaft of the rotatable block is reduced. Thus the shaft of the rotatable block is easily sliding out from the curve sliding surface. This causes that the shaft of the rotatable block is separated from the drag plate when a film clamping and cutting rod and the clamp have not contacted and cut a film yet. Thus the clamp is closed, the film is not cut off and the residual film is not ripped off completely. Moreover, the distance between the film and objects to be wrapped is increased by a film guiding member and this is beneficial to following film cutting process performed by the film clamping and cutting rod and the clamp. However, the film guiding member including a film guiding rod and a connection rod occupies quite a lot space. The manufacturing cost is increased. These component are assembled and easily to fall off. This has negative effect on synchronous movement of the film clamping and cutting rod and the clamp.

SUMMARY OF THE INVENTION

Therefore it is a primary object of the present invention to provide a film clamping and cutting device of stretch wrapping machines that includes a film clamping and cutting rod and a clamp used as auxiliaries of a film clamping and cutting unit. When the film clamping and cutting rod and the clamp reach certain positions, the clamping and cutting of a film is completed precisely.

In order to achieve the above object, a film clamping and cutting device of stretch wrapping machines according to the present invention includes a turntable, a braking unit disposed beside the turntable, a film clamping and cutting unit arranged at the turntable, and a drag set disposed on the turntable. The drag set includes a rotatable block that is connected to a central shaft of an assembly wheel of the film clamping and cutting unit. One end of the rotatable block is connected to a connection rod and the connection rod is connected to a clamp of a film clamping and cutting rod. An elastic part is disposed between the rotatable block and the film clamping and cutting rod. The other end of the rotatable block is connected to a shaft. The drag set is disposed with a fixing base that is pivotally connected with a drag plate and a clip is pivotally connected to one end of the drag plate. A clip space for receiving the shaft is formed between the drag plate and the clip. The clip space is mounted with an elastic body while two ends of the elastic body are respectively connected to the drag plate and the clip. The other end of the drag plate is connected to an elastic part.

By means of the drag plate, the clip and the elastic body of the drag set, the shaft connected to the rotatable block is not released from the clip space until the film clamping and cutting rod and the clamp reach certain positions. Thus the connection rod disposed on the rotatable block drives the clamp to clip the film timely so as to complete clamping and cutting of the film precisely.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
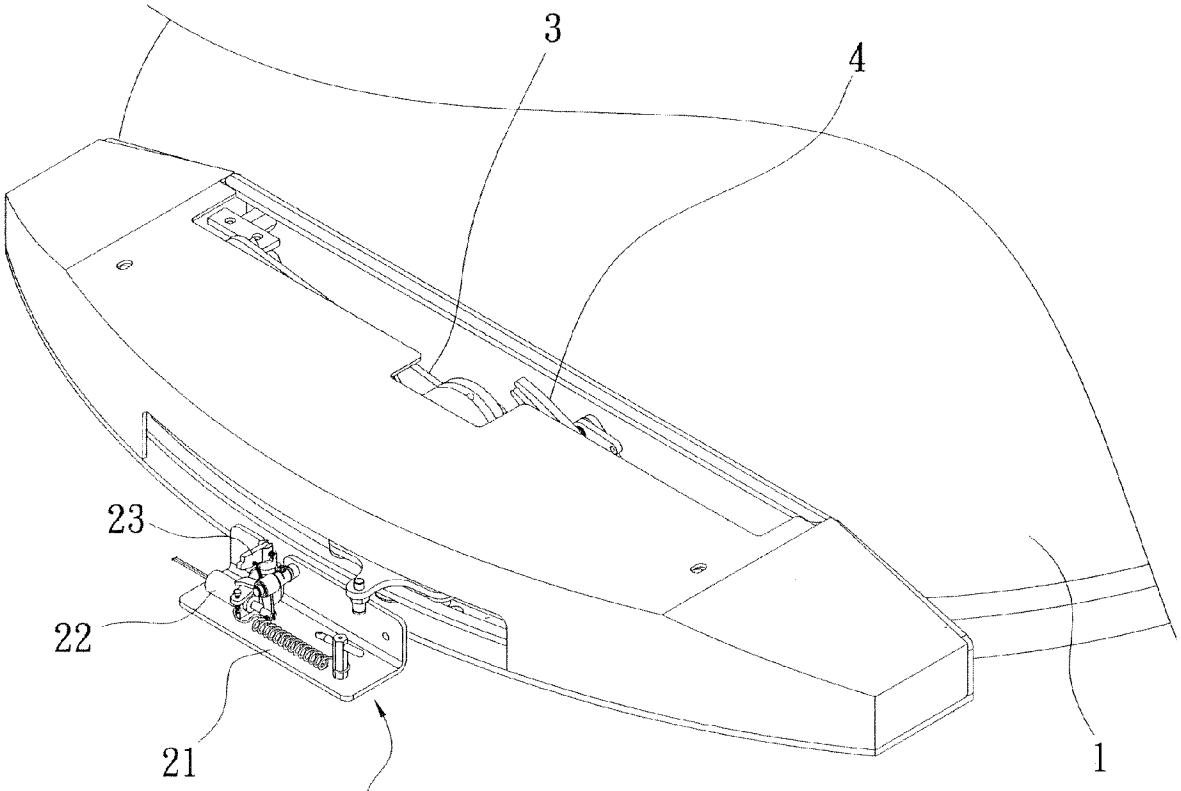
FIG. 1 is a perspective view of an embodiment according to the present invention.
Figure 2:
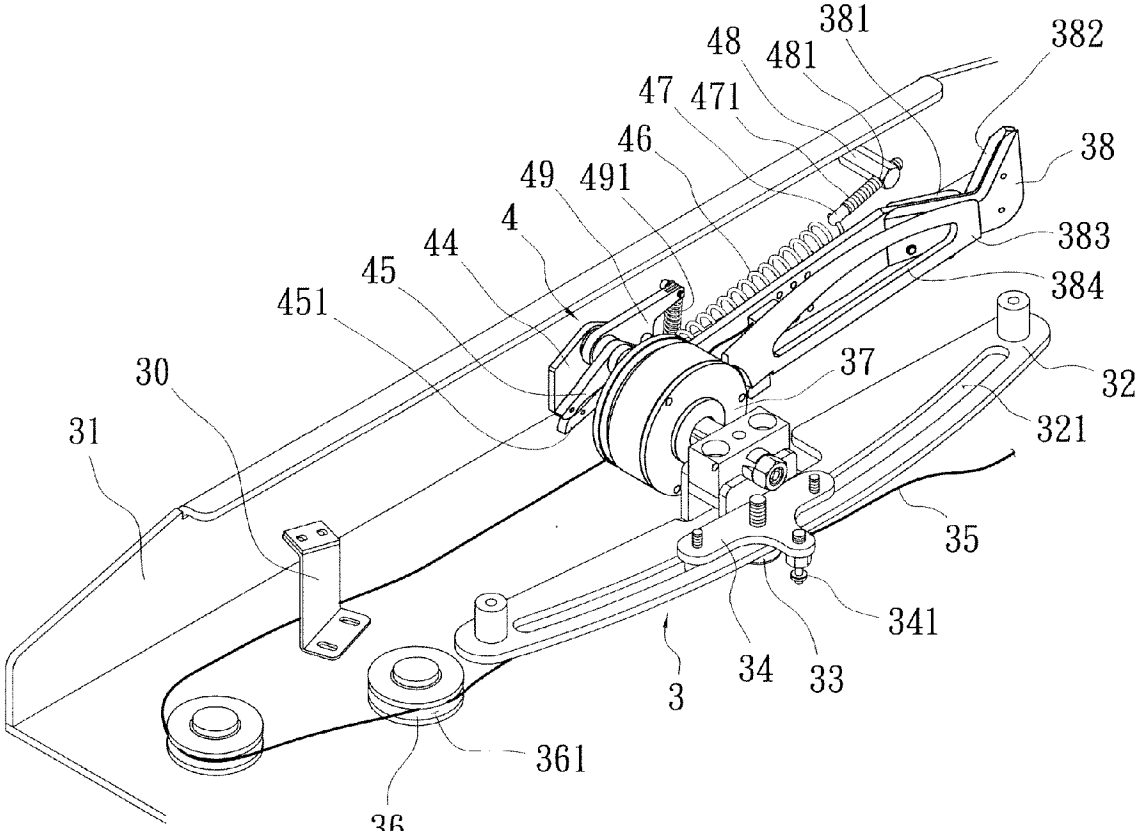
FIG. 2 is a perspective view of an embodiment according to the present invention.

Refer to FIG. 1 and FIG. 2, a film clamping and cutting device of stretch wrapping machines includes a turntable 1, a braking unit 2 disposed beside the turntable 1, a film clamping and cutting unit 3 arranged at the turntable 1, and a drag set 4 mounted on the turntable 1. The film clamping and cutting unit 3 and the drag set 4 are arranged at the turntable 1.

Figure 3:
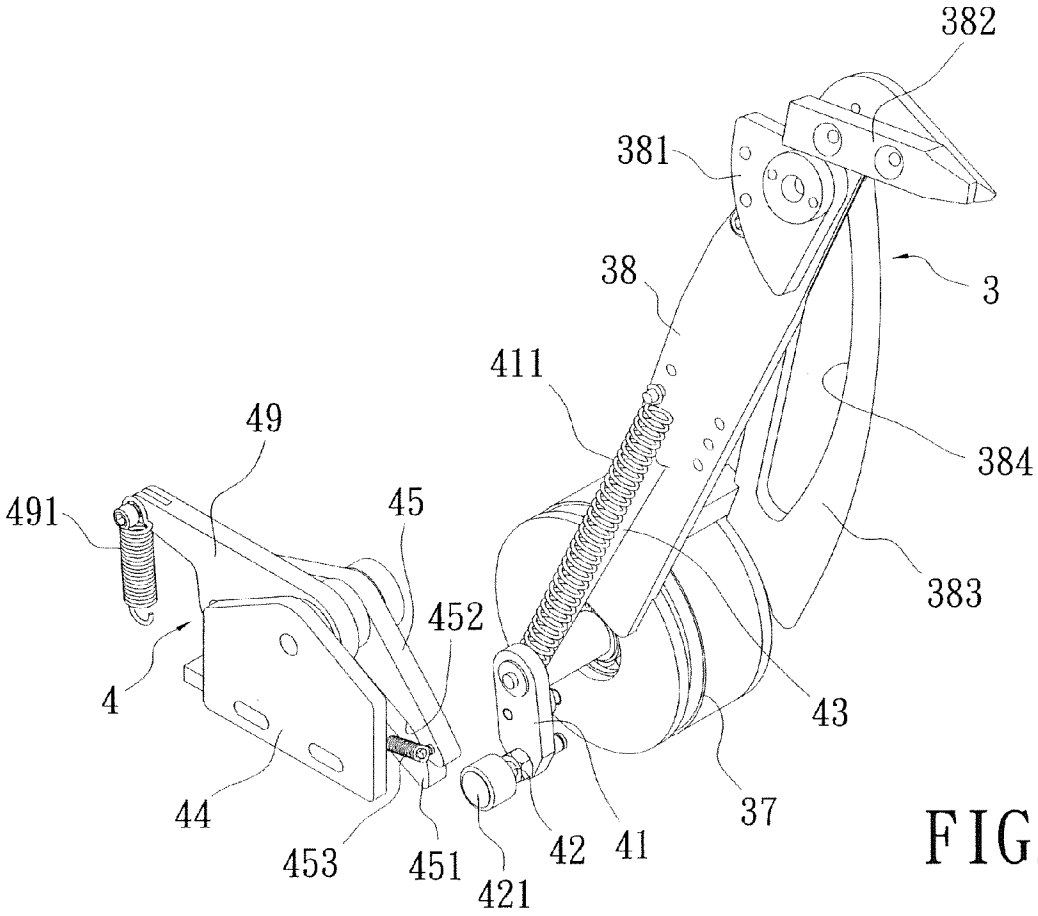
FIG. 3 is a partial enlarged view of an embodiment according to the present invention.

Also refer to FIG. 3, the film clamping and cutting unit 3 consists of a film clamping and cutting body 31 disposed on the turntable 1, a guiding plate 32 arranged at the film clamping and cutting body 31, a string fixing block 33, a connection plate 34, a string 35, a plurality of drive wheels 36, an assembly wheel 37, a film clamping and cutting rod 38. A curved guiding slot 321 is formed on the guiding plate 32 and the string fixing block 33 is mounted in the curved guiding slot 321. The connection plate 34 is disposed over the string fixing block 33 and a stopping block 341 is arranged at the connection plate 34. The stopping block 341 is corresponding to a stopping plate 23 connected to a power source 22 inside a base 21 of the braking unit 2. One end of the string 35 which is a steel wire is connected to the string fixing block 33 under the connection plate 34 while the other end of the string 35 is connected to the film clamping and cutting rod 38 that is connected to and disposed with the assembly wheel 37. Moreover, the drive wheels 36 are disposed on the film clamping and cutting body 31 and arranged between the film clamping and cutting rod 38 and the string fixing block 33. A groove 361 is formed on each drive wheel 36, allowing the string 35 (steel wire) to wind around the drive wheels 36. A clamp 381 and a blade 382 are disposed on a front end of the film clamping and cutting rod 38 and the blade 382 is outer than the clamp 381. Furthermore, an elastic body such as a spiral spring is mounted in the assembly wheel 37. A chopping block 30 is disposed on the film clamping and cutting body 31, located at the position where the blade 382 falls. A film guiding rod 383 with a hollow-out part 384 is disposed between the assembly wheel 37 and a rear part of the film clamping and cutting rod 38.

Figure 4:
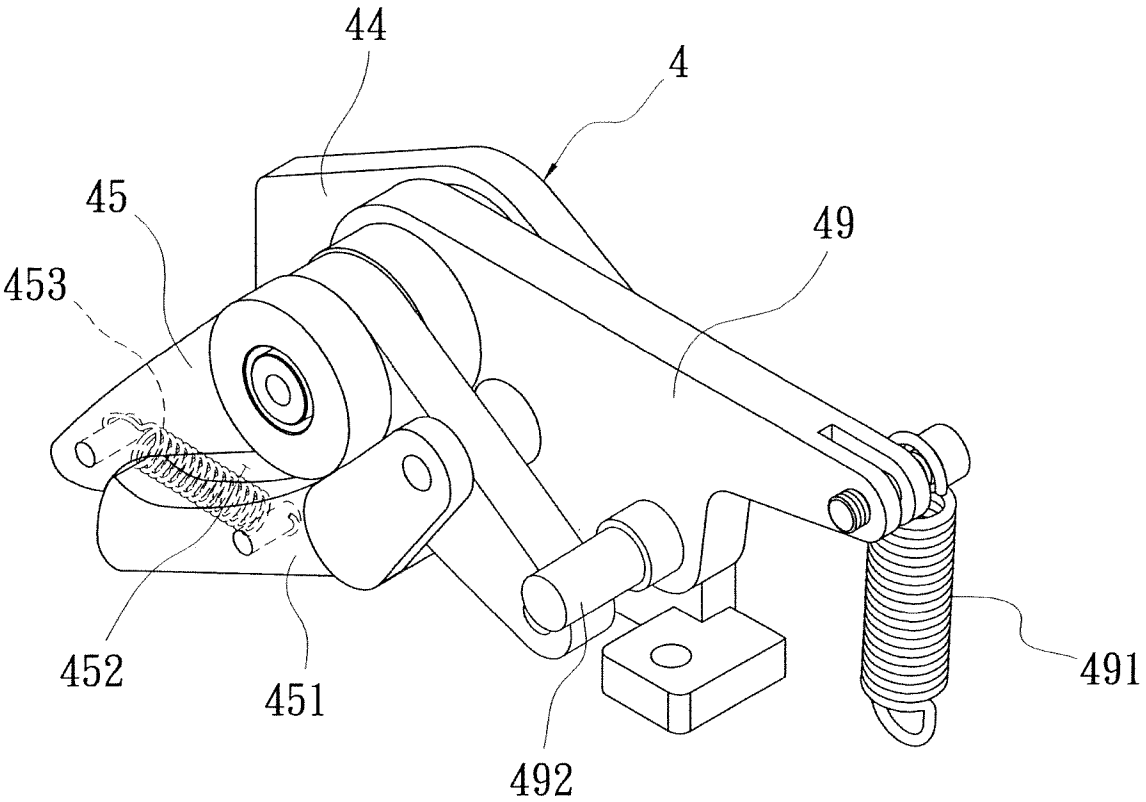
FIG. 4 is an enlarged perspective view of a drag set of an embodiment according to the present invention.

The drag set 4 includes a rotatable block 41, a shaft 42, a connection rod 43, a fixing base 44, a drag plate 45, an elastic part 46, an adjustment rod 47, an adjustment base 48, and a stopper plate 49. The rotatable block 41 is connected to a central shaft of the assembly wheel 37 of the film clamping and cutting unit 3. One end of the rotatable block 41 is connected to the shaft 42 and the other end of the rotatable block 41 is connected to one end of the connection rod 43 while the shaft 42 is disposed with a pulley 421. The other end of the connection rod 43 is connected to the clamp 381 of the film clamping and cutting unit 3. An elastic part 411 is disposed between the rotatable block 41 and the film clamping and cutting rod 38. Refer to FIG. 4, the fixing base 44 of the drag set 4 is fixed on the film clamping and cutting body 31 and the drag plate 45 is pivotally connected to the fixing base 44. A clip 451 is pivoted to one end of the drag plate 45 and a clip space 452 is formed between the drag plate 45 and the clip 451. The clip space 452 is used for receiving the pulley 421 of the shaft 42 and an elastic body 453. Two ends of the elastic body 453 are respectively connected to the drag plate 45 and the clip 451. The other end of the drag plate 45 is connected to one end of the elastic part 46. The other end of the elastic part 46 is connected to the adjustment rod 47. A threaded segment 471 is formed on the adjustment rod 47 so as to be engaged with a screw hole 481 of the adjustment base 48 fixed on the film clamping and cutting body 31. The stopper plate 49 is pivotally connected to the fixing base 44. One end of the stopper plate 49 is connected to one end of an elastic body 491 while the other end of the elastic body 491 is connected to the fixing base 44. A stopper rod 492 is projecting from the other end of the stopper plate 49, located above the drag plate 45 and against the upper edge of the drag plate 45.

Thereby while in use, as shown in FIG. 1, objects going to be wrapped are set on the turntable 1. Then the turntable 1 is turned on and rotated. The objects are also rotated along with the rotation of the turntable 1 to be wrapped from top to bottom by a film from a film output device. When the film is wrapped to the bottom of the objects the last time, the turntable 1 detects the status and slows down output of rotary power. When the power of the turntable 1 stops, the turntable 1 continues rotating due to inertia.

When the turntable 1 stops, as shown in FIG. 2, the power source 22 inside the braking unit 2 is turned on and making the stopping plate 23 and the stopping block 341 on the connection plate 34 of the film clamping and cutting unit 3 against each other so as to stop the connection plate 34 assembled with the stopping block 341 at a certain position. At the same time, the film clamping and cutting body 31 fixed on the turntable 1 keeps moving along with the revolving turntable 1. Then the string fixing block 33 on the bottom of the connection plate 34 is sliding and moving in the curved guiding slot 321 formed on the guiding plate 32 so that the film clamping and cutting body 31 connected to the guiding plate 32 will not stop moving due to the connection plate 34 stopped at the certain position.

Next along with the movement of the film clamping and cutting body 31, each component pivotally connected to the film clamping and cutting body 31 also moves. The string 35, having one end fixed on the bottom of the connection plate 34 and the other end connected to the assembly wheel 37, is driven by the plurality of drive wheels 36 to pull the film clamping and cutting rod 38 on the other end thereof stably. Thus the film clamping and cutting rod 38 is rotated and moved.

Figure 5:
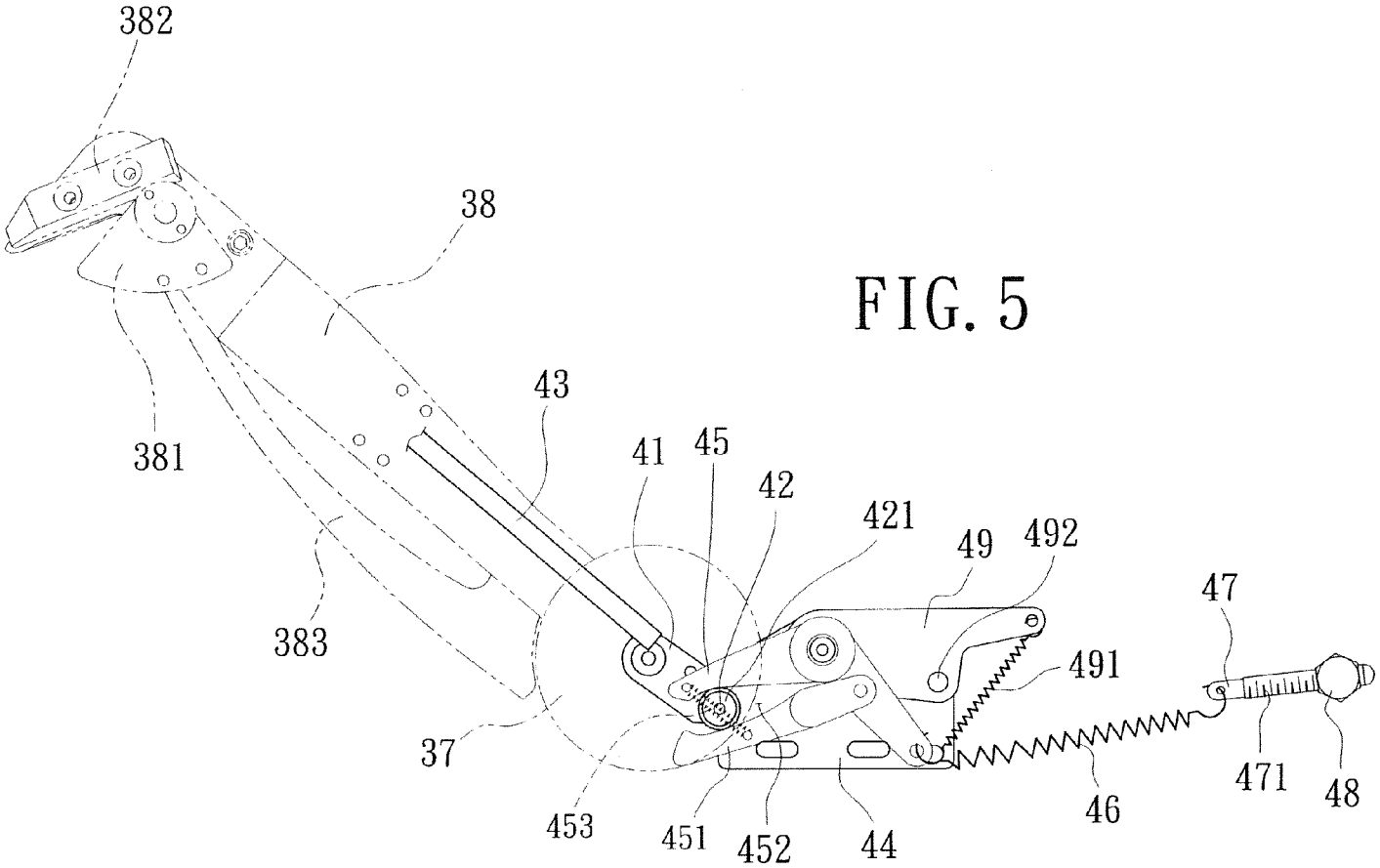
FIG. 5 is an embodiment in a using state according to the present invention.

At this moment, refer to FIG. 5, the film clamping and cutting rod 38 is moved downward and the film guiding rod 383 is against the film to expand the film and increase the distance between the film and the objects to be wrapped. Thus the film clamping and cutting rod 38 can precisely tear the film when it moves toward the chopping block 30. Then the clamp 381 on the front end thereof is used for clamping edges of the film and tightening the film and the film is cut at the chopping block 30. Thus the film is wrapped and sealed over the objects.

When the film clamping and cutting rod 38 is moved downward, it synchronously drives the connected assembly wheel 37 to move. Thus the rotatable block 41 of the drag set 4 that is connected to the central shaft of the assembly wheel 37 is rotated at the same time. When the central shaft of the assembly wheel 37 drives the rotatable block 41 to rotate, the shaft 42 connected to the rotatable block 41 also revolves through a certain angle to push one end of the drag plate 45 moving up to a certain magnitude. Used the area the drag plate 45 pivotally connected to the fixing base 44 as a pivot point, the other end of the drag plate 45 is moving downward a level and the elastic part 46 connected to the other end of the drag plate 45 is pulled and extended. At this moment, the pulley 421 of the shaft 42 is gradually released from the clip space 452 between the drag plate 45 and the clip 451. After the shaft 42 not being pulled by the drag plate 45, the elastic part 411 originally extended due to the rotatable block 41 pulled by the drag plate 45 will turn back to the original position so as to drive the rotatable block 41 rotate toward the film clamping and cutting rod 38. Then the connection rod 43 connected to the rotatable block 41 is going to push against the clamp 381 along with the rotation of the rotatable block 41 so that the clamp 381 goes close to and clips the film tightly. Thereby while reaching the chopping block 30 thereunder, the film clipped between the clamp 381 and the film clamping and cutting rod 38 is cut off at the copping block 30 and the film wrapped over the objects is sealed. At the same time, the edges of the film being cut off are still clipped between the film clamping and cutting rod 38 and the clamp 381.

Figure 6:
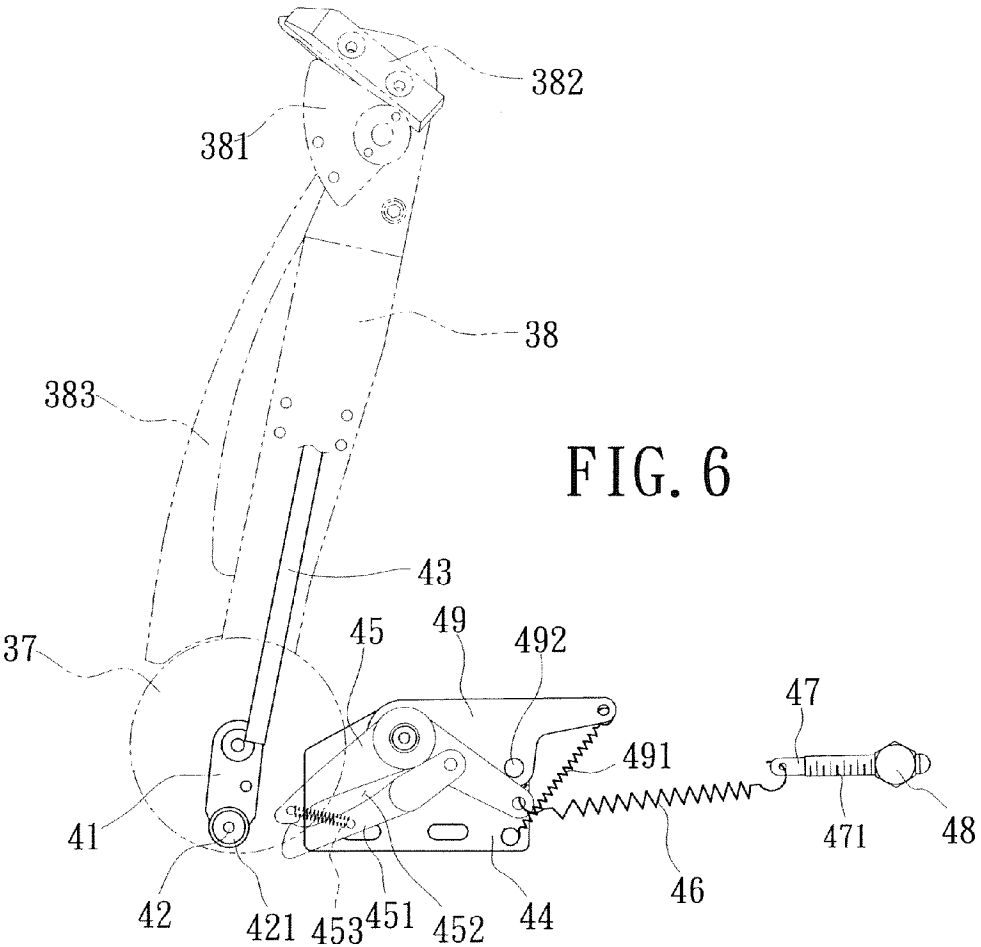
FIG. 6 is an embodiment in a using state according to the present invention.

Refer to FIG. 6, while the pulley 421 of the shaft 42 being released from the clip space 452 between the drag plate 45 and the clip 451, the elastic part 46 connected to the drag plate 45 turns back and makes the drag plate 45 go back to the original position. Thus the pulley 421 of the shaft 42 connected to the rotatable block 41 is clipped and stopped in the clip space 452 between the drag plate 45 and the clip 451 again for next film cutting of the film clamping and cutting rod 38.

Due to the elastic body 453 located between the drag plate 45 and the clip 451, a clipping force of the clip space 452 is maintained. Thus it is assured that the shaft 42 connected to the rotatable block 41 is not released until the film clamping and cutting rod 38 and the clamp 381 reach certain positions. Therefore the clamp 381 clips the film timely, the film is precisely cut off and the residual film is ripped off. Moreover, the film guiding rod 383 and the film clamping and cutting rod 38 can be integrated into one component. Such design can not only reduce manufacturing cost but also provide easy and convenient assembling. The film guiding rod 383 can be used in conjunction with the film clamping and cutting rod 38 and the clamp 381 to cut off the film precisely.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A film clamping and cutting device of stretch wrapping machines comprising:

a turntable;

a braking unit disposed beside the turntable, a film clamping and cutting unit arranged at the turntable and having an assembly wheel, a film clamping and cutting rod and a clamp disposed on the film clamping and cutting rod, and a drag set mounted on the turntable and having a rotatable block that is connected to the assembly wheel of the film clamping and cutting unit; one end of the rotatable block is connected to a connection rod and the connection rod is connected to the clamp of the film clamping and cutting rod while the other end of the rotatable block is connected to a shaft; a first elastic part is disposed between the rotatable block and the film clamping and cutting rod; the drag set further includes a fixing base, a drag plate that is pivotally connected to the fixing base and having a clip pivotally connected to one end thereof, a clip space formed between the drag plate and the clip, and a first elastic body having two ends, the ends respectively connected to the drag plate and the clip, and a second elastic part connected to the other end of the drag plate.

2. The device as claimed in claim 1, wherein the film clamping and cutting rod is disposed with a film guiding rod.

3. The device as claimed in claim 2, wherein the film guiding rod is arranged between the assembly wheel and a rear part of the film clamping and cutting rod.

4. The device as claimed in claim 2, wherein a hollow-out part is mounted on the film guiding rod.

5. The device as claimed in claim 1, wherein one end of the shaft of the drag set is disposed with a pulley and the pulley is located in the clip space formed between the drag plate and the clip.

6. The device as claimed in claim 1, wherein the drag set further includes an adjustment rod and an adjustment base; a threaded segment is formed on the adjustment rod while at least one screw hole is arranged at the adjustment base and the screw hole is engaged with the threaded segment of the adjustment rod; the adjustment rod is connected to the second elastic part on the other end of the drag plate.

7. The device as claimed in claim 1, wherein the drag set further includes a stopper plate that is pivotally connected to the fixing base; one end of the stopper plate is connected to one end of an elastic body while the other end of the elastic body is connected to the fixing base; the other end of the stopper plate is connected to a stopper rod and the stopper rod is against the drag plate.

8. The device as claimed in claim 7, wherein the stopper rod of the stopper plate is against an upper edge of the drag plate.

9. The device as claimed in claim 1, wherein the film clamping and cutting unit further includes a film clamping and cutting body fixed on the turntable, a guiding plate arranged at the film clamping and cutting body, a string fixing block, a connection plate, a string, a plurality of drive wheels, an assembly wheel, and a film clamping and cutting rod; a curved guiding slot is formed on the guiding plate and the string fixing block is mounted in the curved guiding slot while the connection plate is disposed over the string fixing block and a stopping block corresponding to the braking unit is arranged at the connection plate; one end of the string is connected to a bottom of the connection plate while the other end of the string is connected to the film clamping and cutting rod that is connected to and assembled with the assembly wheel; the assembly wheel is pivotally connected to the film clamping and cutting body; the drive wheels connected to the film clamping and cutting body are arranged between the film clamping and cutting rod and the connection plate, allowing the string to wind around the drive wheels; a clamp and a blade are disposed on a front end of the film clamping and cutting rod and the blade is outer than the clamp; a second elastic body is mounted in the assembly wheel while a chopping block is disposed on the film clamping and cutting body, located at the position where the blade falls.

10. The device as claimed in claim 9, wherein the braking unit includes a base, a power source mounted in the base, and a stopping plate connected to the power source; the stopping plate is corresponding to the stopping block of the film clamping and cutting unit and is used to stop the stopping block.

* * * * *